US012163329B2

(12) United States Patent
Deen et al.

(10) Patent No.: US 12,163,329 B2
(45) Date of Patent: Dec. 10, 2024

(54) WALL ASSEMBLY

(71) Applicant: DK GEVELS B.V., Hoorn (NL)

(72) Inventors: Dennis Jacobus Theodorus Deen, Hoorn (NL); Caspar Maria Van Der Zanden, Delft (NL)

(73) Assignee: DK GEVELS B.V., Hoorn (NL)

( * ) Notice: Subject to any disclaimer, the term of this patent is extended or adjusted under 35 U.S.C. 154(b) by 0 days.

(21) Appl. No.: 17/261,779

(22) PCT Filed: Jul. 22, 2019

(86) PCT No.: PCT/NL2019/050504
§ 371 (c)(1),
(2) Date: Jan. 20, 2021

(87) PCT Pub. No.: WO2020/017975
PCT Pub. Date: Jan. 31, 2020

(65) Prior Publication Data

US 2021/0293018 A1 Sep. 23, 2021

(30) Foreign Application Priority Data

Jul. 20, 2018 (NL) ..... 2021372
Apr. 30, 2019 (NL) ..... 2023037

(51) Int. Cl.
*E04B 2/16* (2006.01)
*E04B 2/02* (2006.01)

(52) U.S. Cl.
CPC ..... *E04B 2/16* (2013.01); *E04B 2002/0245* (2013.01); *E04B 2002/0282* (2013.01); *E04B 2002/0284* (2013.01)

(58) Field of Classification Search
CPC ..... E04B 2/08; E04B 2/16; E04B 2002/0245; E04B 2002/0282; E04B 2002/0284
(Continued)

(56) References Cited

U.S. PATENT DOCUMENTS 555,693 A * 3/1896 Geraerdts ..... E04B 2002/0245 52/437
1,355,572 A * 10/1920 Herbert ..... E04B 1/04 52/316

(Continued)

FOREIGN PATENT DOCUMENTS

CA 1083846 A 8/1980
CA 2220743 C * 10/2000 ..... E04B 2/18

(Continued)

OTHER PUBLICATIONS

Translation of FR 1476209 A retrieved from ESPACE including bibliographic data, description and claims and original document granted Apr. 7, 1967 https://worldwide.espacenet.com/publicationDetails/biblio?DB=EPODOC&II=0&ND=3&adjacent=true&locale=en_EP&FT=D&date=19670407&CC=FR&NR=1476209A&KC=A (Year: 2022).*

(Continued)

*Primary Examiner* — Brian D Mattei
*Assistant Examiner* — Joseph J. Sadlon
(74) *Attorney, Agent, or Firm* — Steven M. Koehler; Westman, Champlin & Koehler, P A.

(57) ABSTRACT

A wall and an assembly for building the wall comprises building blocks and support blocks. Each building block comprises opposite first and second faces, both comprising a plurality of recesses arranged spaced from each other. Each support block comprises a body and a plurality of protrusions extending from opposite top and bottom sides of the body. Each recess comprises a recess support structure and each protrusion comprises a protrusion support structure. The recesses and protrusions are arranged in a matching pattern. Alternating layers of building and support blocks are stacked on top of each other wherein the protrusions of one layer are accommodated in the recesses of the adjacent layer, the respective support structures engage each other and (Continued)

position and support the respective higher block on the respective lower block, and relative movement of the respective blocks in two mutually perpendicular directions generally parallel to the layers is restricted.

24 Claims, 12 Drawing Sheets

(58) Field of Classification Search
USPC ..... 52/585.1
See application file for complete search history.

(56) References Cited

U.S. PATENT DOCUMENTS 1,427,372 A * 8/1922 Geraerdts ..... E04B 2/08 52/715
1,447,827 A * 3/1923 Warner ..... E04B 2/08 52/414
1,521,430 A * 12/1924 Campbell ..... E04B 2/28 52/585.1
1,665,442 A * 4/1928 Leon ..... E04B 2/08 52/274
2,107,144 A * 2/1938 Davis ..... E04B 2/08 52/506.1
2,212,184 A * 8/1940 Powell ..... E04B 2/08 52/564
2,303,091 A * 11/1942 Putnam ..... B28B 23/00 52/412
2,683,968 A * 7/1954 Budd ..... E02B 3/06 405/33
2,684,588 A * 7/1954 Robertson ..... E04B 2/30 52/426
2,971,295 A * 2/1961 Reynolds ..... E02D 27/01 52/294
3,076,286 A * 2/1963 Czecholinski ..... A63H 33/082 52/480
3,295,286 A * 1/1967 Schaich ..... E04B 1/043 52/583.1
3,296,758 A * 1/1967 Knudsen ..... E04B 2/10 52/223.7
3,374,589 A * 3/1968 Neal, Jr. ..... E04G 21/1841 52/749.13
3,429,092 A * 2/1969 Hart ..... E04B 1/20 52/236.7
3,430,404 A * 3/1969 Muse ..... E04B 2/46 52/439
3,478,482 A * 11/1969 Weir ..... E04G 21/14 52/745.11
3,511,000 A * 5/1970 Keuls ..... E04B 2/7863 52/585.1
3,537,687 A * 11/1970 Adelman ..... E02D 29/0266 47/33
3,686,873 A * 8/1972 Vidal ..... E02D 29/0241 405/262
3,759,003 A * 9/1973 Wilson ..... E04B 2/12 52/285.4
4,067,165 A * 1/1978 Timmons ..... E04B 2/7425 52/282.4
4,107,894 A * 8/1978 Mullins ..... E04B 2/18 52/592.6
4,110,949 A * 9/1978 Cambiuzzi ..... E04B 2/42 52/437
4,228,628 A 10/1980 Schlomann
4,565,042 A * 1/1986 von Poschinger-Camphausen ..... A47B 47/042 446/122
4,912,866 A * 4/1990 Bannister ..... E04B 2/7431 40/733
4,975,008 A * 12/1990 Wagner ..... F16B 43/001 411/533
5,078,354 A * 1/1992 Kim ..... E04B 2/18 446/128
5,240,343 A * 8/1993 Strobl, Jr. ..... E01C 11/221 404/8
5,248,226 A * 9/1993 Risi ..... E04B 2/08 52/286
5,471,808 A * 12/1995 De Pieri ..... A63H 33/086 52/603
5,560,167 A * 10/1996 Miceli ..... E04C 1/40 52/285.4
5,694,997 A * 12/1997 Styger ..... G09F 15/0068 52/272
5,729,948 A * 3/1998 Levy ..... E04B 1/2604 297/440.22
5,829,217 A * 11/1998 Colen ..... E04B 2/16 52/421
5,881,515 A * 3/1999 George ..... E04B 2/702 52/169.4
5,890,332 A * 4/1999 Skidmore ..... E04B 2/08 52/274
5,934,037 A * 8/1999 Bundra ..... E04B 2/08 52/603
6,000,186 A 12/1999 Fielding et al.
6,266,934 B1 * 7/2001 Houseal ..... E04B 2/702 52/745.1
6,571,525 B2 * 6/2003 Coleman ..... E04B 2/08 52/592.1
6,585,028 B2 * 7/2003 Verdicchio ..... E04B 2/7422 52/239
6,991,397 B2 * 1/2006 Welch ..... F16B 19/02 403/309
7,546,712 B2 * 6/2009 Shaw ..... E04B 2/18 52/439
7,594,370 B2 * 9/2009 Clarke ..... E04B 2/702 52/582.1
7,815,391 B2 * 10/2010 Kauppila ..... F16B 13/126 403/194
7,836,646 B2 * 11/2010 Matsufuji ..... E04B 2/16 52/489.1
7,837,007 B2 * 11/2010 Hotzeldt ..... B60R 13/0815 181/194
7,946,086 B2 * 5/2011 Hammer ..... E04C 5/08 52/223.5
7,975,444 B2 * 7/2011 Holdsworth ..... E04B 1/043 52/565
8,127,505 B2 * 3/2012 Lu ..... E04B 2/18 52/582.1
8,176,697 B1 * 5/2012 Bolander, II ..... E04B 1/4157 52/309.4
8,568,187 B2 * 10/2013 Norman ..... A63H 33/084 446/124
8,898,990 B2 * 12/2014 Drew ..... E04B 1/40 52/600
9,010,059 B2 * 4/2015 Lin ..... A63H 33/107 52/603
9,206,597 B2 * 12/2015 Marsh ..... E04B 2/16
9,428,926 B2 * 8/2016 Kramer ..... E04H 1/00
9,593,480 B2 * 3/2017 Vandenbempt ..... E04B 2/26
9,689,160 B2 * 6/2017 Lanese ..... E04B 2/08
10,106,980 B2 * 10/2018 Martinez ..... E04B 2/08
10,202,755 B2 * 2/2019 Montminy ..... E04B 2/30
10,273,683 B2 * 4/2019 Fryfogle ..... E04B 2/12
10,617,969 B2 * 4/2020 Landau ..... A63H 33/107
10,669,711 B2 * 6/2020 Parshad ..... E04B 2/08
10,738,463 B2 * 8/2020 Miller ..... E04B 1/585
2004/0040249 A1 * 3/2004 Herbison ..... E04B 2/16 52/565
2006/0185300 A1 * 8/2006 Tremblay ..... E04B 2/16 52/564
2007/0234665 A1 * 10/2007 Price ..... E04C 1/395 52/311.1
2008/0216438 A1 * 9/2008 Schager ..... E04B 2/06 52/590.2
2011/0041436 A1 * 2/2011 Sigurdson ..... E04B 1/04 52/585.1

(56) References Cited

U.S. PATENT DOCUMENTS

| | | | | |
|---|---|---|---|---|
| 2014/0090325 | A1 | 4/2014 | Maeers | |
| 2014/0106108 | A1* | 4/2014 | Lin | A63H 33/082 428/58 |

FOREIGN PATENT DOCUMENTS

| | | | | | |
|---|---|---|---|---|---|
| CA | 2284194 | A1 | * | 3/2001 | E04B 2/16 |
| CA | 2496066 | A1 | * | 8/2006 | E04B 2/16 |
| DE | 10033481 | A1 | * | 1/2002 | E04B 2/16 |
| EP | 0118374 | A2 | * | 9/1984 | E04B 2/8641 |
| EP | 0748905 | A1 | * | 12/1996 | E04B 2/16 |
| FR | 1387024 | A | * | 1/1965 | E04C 2/041 |
| FR | 1476209 | A | | 4/1967 | |
| FR | 2912163 | A1 | * | 8/2008 | E04B 2/16 |
| GB | 2065740 | A | * | 7/1981 | E04B 1/6158 |
| GB | 2215749 | A | | 9/1989 | |
| GB | 2320041 | A | | 6/1998 | |
| GB | 2390860 | A | * | 1/2004 | E04B 2/16 |
| GB | 2528155 | A | * | 1/2016 | A63H 33/107 |
| WO | WO-8402154 | A1 | * | 6/1984 | E04B 1/21 |
| WO | WO-2010100534 | A2 | * | 9/2010 | E04B 2/06 |
| WO | WO-2013098448 | A1 | * | 7/2013 | E04B 2/06 |
| WO | WO-2015132422 | A1 | * | 9/2015 | E04B 2/16 |
| WO | 2017183967 | A1 | | 10/2017 | |

OTHER PUBLICATIONS

International Search Report and Written Opinion for International Application No. PCT/NL2019/050504, dated Oct. 14, 2019.

* cited by examiner

WALL ASSEMBLY

CROSS-REFERENCE TO RELATED APPLICATION

This Application is a Section 371 National Stage Application of International Application No. PCT/NL2019/050504, filed Jul. 22, 2019 and published as WO 2020/017975 A1 on Jan. 23, 2020, in English, the contents of which are hereby incorporated by reference in their entirety.

TECHNICAL FIELD

The present disclosure relates to construction techniques, in particular methods and devices for building at least part of a wall and constructions comprising such wall or wall part. More in particular, the present disclosure relates to building walls, in particular dry walls.

BACKGROUND

Construction of walls from construction blocks using bricks and mortar and the like is generally known. Dry wall constructions are also known.

Although mortar-based walls and dry walls have been built for ages, improvements are continuously desired to provide stronger, lighter and/or cheaper constructions, and/or to reduce aspects as one or more of time, costs, materials, builder skills, etc. involved with the building.

SUMMARY

In aspects, a wall and an assembly for building at least part of the wall are provided.

The wall and the assembly comprises building blocks and support blocks. Each building block comprises opposite first and second faces, both comprising a plurality of recesses arranged spaced from each other. Each support block comprises a body and a plurality of protrusions extending from opposite top and bottom sides of the body. Each recess of the plurality of recesses comprises a recess support structure and each protrusion of the plurality of protrusion comprises a protrusion support structure. The recesses and protrusions are arranged in a matching pattern.

In the assembled wall, alternating layers of building blocks and support blocks are stacked on top of each other such that

- the protrusions in one layer are accommodated in the recesses of the adjacent layer,
- the respective support structures engage each other and position and support the respective higher block on the respective lower block, and
- relative movement of the respective blocks in two mutually perpendicular directions generally parallel to the layers is restricted.

Thus, the building blocks and support blocks support each other, so that the wall may reach a desired height, and they interengage and interlock each other, defining relative positions within a layer fortifying the layer and therewith fortifying the wall as a whole. Also, in plural directions, generally three mutually perpendicular directions, tolerances are defined by the interplay of (the recesses can protrusions of, respectively) the building blocks and support blocks, rather than just the outside shape, structure and/or texture of the building blocks and/or support blocks as a whole. Thus, constructing a wall, and therewith constructing an object comprising the wall, by appropriately assembling the respective building blocks and support blocks is facilitated.

Each support block may have a length, a width, and a height, in, respectively, a length direction L, a width direction W, and a height direction H, and the protrusions may be spaced at least in the length direction L of the support block. In the building blocks, the recesses are accordingly distributed in the faces.

The pattern in which the recesses and protrusions are arranged may be limited to specific pairs of a building block and a support block or larger groups of blocks. One or more blocks (building block or support block, respectively) may at least partly overlap plural adjacent blocks (support block or building block, respectively), e.g. by staggered arrangement and/or by one block having a length and/or width different from a length and/or width of an adjacent block with which it is operably coupled by cooperation of their respective protrusion and recesses. Thus, a positioning and/or interlocking effect in the length and/or width direction may be achieved in a wall portion constructed with the assembly.

In an embodiment, each building block comprises a plurality of recesses arranged spaced from each other in at least one of the width and height directions, and the assembly comprises matching support blocks. Thus, when placing alternating layers of building blocks and support blocks on and/or adjacent each other the protrusions can be accommodated in the recesses and the respective support structures can engage each other and position the respective adjacent blocks with respect to each other. Thus, the building blocks and support blocks interengage and interlock each other also in a length direction. This facilitates defining relative positions in length and/or width directions and it facilitates constructing a wall by appropriately assembling the respective blocks into the alternating layers.

In each building block, the recess support structures are formed with respect to one reference. The reference preferably is or identifies a plane, more preferably a midplane of the building block. At least some of the recesses may be formed in the building block by cutting. Cutting techniques, e.g. one or more of hacking, sawing, milling, drilling, grinding, polishing, etching, etc. have proven to allow reliable manufacturing for forming recesses in building material, which itself may have a rough outer shape. Thus, such post-processing enables use of otherwise more or less irregularly shaped building blocks. Milling and/or sawing can generally be performed at great speed also on site in a construction site.

When forming (at least the support structures of) the recesses relative to the same reference, at least some of them may be formed sequentially and/or simultaneously relative to the same reference. When forming (at least the support structures of) the recesses relative to the same reference, the building block and the reference are preferably positioned and oriented with respect to each other in the same predetermined position and orientation in at least one relative direction, more preferably being in the same relative position and orientation, so that the reference relates to positions and orientations with respect to the building block in a predetermined and reliable manner.

Preferably, the support structures are formed as mated structures; e.g. at least flat or conical surfaces. The larger the contact surface area of engaging support structures, the better and/or reliable the supporting force may be and/or the less the chance that a building block and/or a support block get damaged to local stress build-up and/or to other local forces and/or to other local weaknesses.

Preferably each recess support structure is a support surface and defines a recess support plane.

Preferably each protrusion support structure is a support surface and defines a protrusion support plane.

Preferably all support structures of the plurality of recesses of a building block in at least one of the first and second faces define a common first plane and/or second plane, respectively. Preferably, the first plane and second plane are parallel. In an embodiment, the first plane and second plane may coincide.

Preferably all protrusion support structures of the plurality of protrusions of a support block protruding in one direction from the body define a common first support plane, more preferably all protrusion support structures of the plurality of protrusions of a support block protruding in the opposite direction from the body define a common second support plane. Preferably, the first and second support planes are parallel.

Common planes facilitate design and construction of a wall and/or a building comprising such wall. Further, checking of a construction is facilitated.

When stacked, at least the building blocks are separate from each other and preferably, in each vertical pair the respective blocks do not support each other apart from at the support structures, e.g. support surfaces, preventing interference with the accurate positioning governed by the support structures. The support structures of a recess may be formed by the bottom of the recess.

By forming the first and second recesses to the same reference, accurate control over the position and/or orientation of the respective support surfaces is facilitated. Thus, the relative positions and/or orientations of the recesses can be defined to a high precision at a relatively low cost.

For it has been found that dry wall buildings suffer from tolerance stacking, wherein size fluctuations of elements of different layers add up so that after several layers the wall may deviate from its intended size, in particular its height. This may be acceptable for free-standing objects, dikes and horticulture etc., but not for houses, offices, etc. Moreover, there is a development towards specifying entire buildings and any components therein to ever smaller tolerances, even down to the size and pitch of masonry of walls, so that parts may be manufactured to predefined sizes in advance and construction and/or installation work onsite is reduced. In the traditional way of building, skilled adjustment of mortar and/or cement layers allows for adaptation of varying brick sizes and shapes to such design requirements. However, the numbers of sufficiently skilled masons are dwindling and in any case the construction speed is determined by the process time of setting of the mortar and/or cement layers to allow addition of a further layer of bricks on a wall without deforming a previous layer underneath.

In dry wall constructions in which tolerances to size and stability are tight, currently the top and bottom sides of the building blocks are milled or polished to size. This is expensive and it provides buildings with a relatively "harsh" and/or "sterile" appearance. In the building blocks of the presently provided method, only the support structures need be formed to an accuracy to prevent unacceptable tolerance stacking, enabling reduction of material consumption and/or tool wear. Further, (post-) processing time per building block may be reduced. By forming the support portions in the recesses, the shape, position and/or orientation of the support portions relative to the top/bottom sides of the building blocks may be obscured by lateral portions of the building block defining the recesses. This enables use of building blocks with large variations in their outer surface shape and/or size without affecting building tolerances, enabling benefits in one or more of material costs, production costs and appearance of the wall.

The support blocks may be made to accuracy by the same techniques as the building blocks or other techniques providing uniformity, wherein the uniformity may be masked by the building blocks. Cost benefits due to the speed and ease of manufacturing the building blocks, support blocks and the assembly as a whole are considered to outweigh possible elevated costs for manufacturing the building blocks and support blocks over traditional materials like (mortar and) bricks without further processing thereof.

In an embodiment, the recesses in at least one of the first face and the second face extend parallel to each other. In an embodiment, the recesses in at least one of the first face and the second face extend perpendicular to the first and/or second face, respectively. Each recess may extend along an axis, the axis may extend perpendicular to the first and/or second face.

In an embodiment, the protrusions on at least one of the first and second sides extend parallel to each other. In an embodiment, the protrusions in at least one of the first side and the second side extend perpendicular to the first and/or second side, respectively. Each protrusion may extend along an axis, the axis may extend perpendicular to the first and/or second side.

This facilitates design and construction of the respective blocks as well as of a wall and/or a building comprising such wall. Further, checking of a construction is facilitated.

In an embodiment, at least some recesses in at least one of the first face and at least some recesses in the second face extend coaxial to each other.

In an embodiment, at least some protrusions on the first side and at least some protrusions the second side extend coaxial to each other.

This facilitates defining and/or realising particular relative positions of the building blocks and support blocks. Further, construction forces and/or stresses may be transmitted linearly, which may fortify a wall relative to curved or meandering distributions of relatively elevated forces and/or stresses.

In an embodiment, at least some of the recesses have a shape, in a cross section generally parallel to the first face and/or second face, that is at least one of circular, annular and cylindrical.

In an embodiment, at least some of the protrusions have a shape, in a cross section generally parallel to the first side and/or second side that is at least one of circular, annular and cylindrical.

In an embodiment, at least some of the recesses have a tapering or conical shape, in a direction generally perpendicular to the first face and/or second face.

In an embodiment, at least some of the protrusions have a tapering or conical shape, in a direction generally perpendicular to the first face and/or second face.

Such embodiments each may one or more of facilitate construction of a wall, providing guidance for assembling a wall, and assisting distribution of construction forces and/or stresses.

In an embodiment, at least some of the recesses, preferably all recesses, have an elongated slot shape in the respective face, having a relatively large size (i.e. being relatively long) in a longitudinal direction and a relatively small size (i.e. being relatively short) in a transverse direction perpendicular to the longitudinal direction. Preferably, the longitudinal and transverse directions preferably each extend generally parallel to a respective pair of opposite faces, and/or parallel to reference planes of the building block.

The longitudinal direction may extend generally parallel to a side face of the building block in length direction, e.g. a front face and/or a rear face, and the transverse direction may extend generally parallel to a side face of the building block in width direction, e.g. an end face. In the building block, at least some of the elongated recesses, preferably all, have their longitudinal directions parallel to each other and preferably then being in one line. Also or alternatively, at least some of the recesses, preferably all, have their transverse directions parallel to each other and more preferably then in one line.

Elongated recesses enable adjustment in the direction of elongation of the position of the building block relative to (the protrusions of) a support block, when coupled. The size of the elongated recesses determines the available amount of adjustment and therewith the restriction of the relative movement of the respective blocks in the mutually perpendicular directions generally parallel to layers of coupled blocks. This enables meeting construction tolerances while accommodating building block tolerances.

The shape and size in one direction, preferably the longitudinal direction, of an elongated recess may be significantly larger (i.e. being 2-5 times longer) than a size in corresponding direction of a protrusion of a support block. The shape and size in another direction, preferably the transverse direction, of an elongated recess may be approximately equal to a size in corresponding direction of a protrusion of a support block. In combination, the relative movement of the respective blocks, when coupled with a protrusion accommodated in the elongated recess, is restricted more in one direction (in particular the transverse direction) than in the other direction (in particular the longitudinal direction). Thus, relative adjustment in one direction may be enabled and/or may be larger whereas adjustment in another direction may be prevented and/or may be more limited. In particular, adjustment may be limited essentially in one direction only and over a restricted length, determined by the size and position of the recesses in combination with the size and position of the protrusions accommodated therein. Such adjustment options may facilitate accepting manufacturing tolerances of building blocks and/or support blocks in one or two directions. The elongated recesses preferably extend into the building block in one direction and are enclosed in five directions (i.e. only opening to one face of the building block) so that stacked building blocks appear essentially intact and the recesses do not open to a side face.

Further, it is noted that elongated recesses may be cut by milling techniques. Milling an elongated recess to a predetermined depth may be more easy and accurate than drilling a recess with constant diameter (cylindrical hole), in particular with respect to one or more of:

- removal of material from the recess;
- removal of heat from the drill-/mill-bit and/or the building block; and
- forming a flat bottom of the recess.

The latter may be desired for providing a flat support surface, which may be preferred to provide a constant support height when adjusting a relative position or the building block and support block.

The body of one or more of the support blocks may comprise one or more openings. This can save material and weight.

The body and at least some of the protrusions of one or more of the support blocks may be formed unitary.

Adjacent support blocks may be connected together within one support block layer. For this, support blocks may comprise connectors for mating with an associated connector on another support block. Preferably the connectors are symmetric and/or all support blocks are provided with identical connectors or connector pairs e.g. comprising one connector on one side and a mated counterconnector on an opposite side. One or more of the support blocks may comprise one or more holes for accommodating a protrusion of an adjacent support block. Thus, adjacent support blocks may be connected by concatenation.

Also or alternatively, the assembly may comprise one or more support links for interconnecting adjacent support blocks, e.g. by comprising one or more holes for accommodating a protrusion of an adjacent support block, being generally similar to a support block however not comprising support protrusions.

In each of these cases, the connectors and/or the holes and protrusions may preferably be sized matchingly, e.g. protrusions and holes fitting each other accurately. A support block layer may be assembled from a series of connected support blocks and/or from a series of support blocks and associated links.

Each combination of connectors, in particular a pair of protrusion and hole, may have a predetermined play. The play may be limited down to predetermined tolerances as defined by manufacturing tolerances of the support blocks and/or links; since these may be moulded the manufacturing tolerances may be very tight. Also or alternatively, the play may be of predetermined size as a desired proportion to manufacturing tolerances and/or design tolerances of building blocks and/or a wall. Note that since the building blocks and support blocks rest on each other at the respective support structures, a body of a support block and/or a link may be kept free from supporting contact of building blocks, thus interfering little or not at all with a spacing in stacking direction of adjacent building block layers.

Support blocks and links may be manufactured to tighter tolerances than building blocks; e.g. and in particular when the building blocks comprise bricks, concrete stones and/or natural materials like hewn stone blocks, whereas the support blocks may be moulded and/or milled polymers, metals, etc.

Connectors and/or links may facilitate accommodating spacings between support blocks without affecting a spacing of protrusions otherwise. E.g. links lacking protrusions comprise comparably less material than support blocks, and may serve as adjustment blocks for adjustment of spacing between support blocks and therewith for the spacing between the protrusions. In a particular embodiment of the assembly, the support blocks are sized to fit and to correspond to a particular number of building blocks, in particular two or three building blocks, and links are provided to space adjacent support blocks to accommodate tolerance stacking of building blocks different from and mismatching tolerances of support blocks. Since, as said, support blocks and links may be made to tight tolerances, size-variations of and/or misfit building blocks may be accommodated within a specifically designed wall portion (or even: a building). Note that manufacturing of bricks, and just as well of some other types of building blocks, may result in batches of bricks (or other building blocks) that are several millimetres or even centimetres per single block off of designed sizes, whereas wall portions may have to fit specific sizes and/or specific numbers and/or layouts of building blocks; traditionally such building block tolerances had to be accommodated by skilled masons adjusting spacings with sizing layers of mortar. Nowadays such masonry skills are scarce. The presently provided assembly enables to establish an average size of a batch of building blocks and, using an accordingly designed predetermined arrangement of support blocks and/or links, adjusting the entire wall portion (and hence possibly a building) to a predetermined size, pattern and/or number of building blocks, e.g. as designed by an architect and/or in order to provide a desired relationship (e.g. a ratio) between building blocks and spacing thereof, e.g. in accordance with a relationship (e.g. a ratio) between a length and a width of a building block; with or without an intermediate space such as for a vertical between adjacent building blocks.

An embodiment comprises building a wall using the assembly adjacent another wall and connecting the respective walls together with anchors. The anchors may be attached to the support blocks. Anchors may increase stability of the walls with respect to each other and/or assist in aligning the walls relative to each other. Further, accessory objects, e.g. water conduits and/or electrical cords, may be supported by the anchors. Anchors may be fixed by clamping, friction fit, screwing into a support block and/or building block. An anchor may be used to align a wall relative to another object, e.g. another wall.

The building blocks and the support blocks may be of different materials, e.g. bricks or concrete and, respectively, a polymer material. This may reduce costs and/or it may help mimicking traditional brick and mortar building style. Also, different materials may facilitate attaching objects to the wall using different techniques. Various polymer materials have proven to be sufficiently strong for construction of multiple-storey buildings like houses in which the building blocks are traditional bricks, when the latter are provided with grooves in accordance with the disclosure.

In particular the building blocks may be formed by shaping a malleable material and allowing and/or forcing the shaped material to harden, e.g. by one or more processes of drying, curing and baking, and by forming the recesses of the building blocks in the hardened material. This accommodates using materials wherein the hardening may produce unpredictable deformations relative to the unhardened shape, such as tends to occur by moulding, drying and baking clay to bricks and/or by moulding and drying concrete, which are generally the optimum building materials for walls of houses and similar constructions. However other building blocks may be made by cutting, e.g. sawing or hewing, the building block from a larger object e.g. natural stone blocks cut from a rock.

In particular the support blocks may be formed at least partly by moulding and/or extrusion processes, e.g. forming the support blocks by extrusion of a polymer material, e.g. a polyolefin like a polyethylene (PE) and/or a polypropylene (PP), which may be of (ultra) high molecular weight and/or be reinforced with (glass) fibres, wires, rods and/or other fortification additives. Polyolefins, in particular PE and PP varieties, are proven for use in building construction work, e.g. for housing, being heat resistant, fire-safe and readily workable with woodworking tools, and having thermal expansion characteristics similar to those of concrete and/or bricks.

Metals may also be used as construction material, in particular for support blocks. Several metals and alloys can be suitably extruded or moulded, and may readily be formed for construction of buildings, most notably aluminium and aluminium alloys. Building blocks, and in particular, support blocks may be made of different materials.

Another option which may be preferred is forming of a concrete extraction product. A suitable concrete material can be processed to a desired shape in a robust form. When the material is wetted it may attach and fix itself to surrounding materials, in particular stone-like materials like concrete and brick, with little to no shape change. However, the adherence is strong and permanent. Hosing a (partly) finished wall may therefore fortify the wall.

The support blocks at least partly being received in the building blocks facilitates making that the former are less exposed to weather and/or other external influences. Also, it facilitates making the support blocks smaller than the building blocks, in particular in directions perpendicular to the directions of the wall. This facilitates use of a possibly more susceptible or delicate material than that of the building blocks.

In an embodiment, in the wall support blocks are receded behind a wall surface defined by side surfaces of building blocks, forming recesses, and wherein the method further comprises filling at least part of the recesses with a filler material. This may serve for structural integration and/or fortification of the wall e.g. by covering the support blocks, but also or alternatively for decoration and/or adaptation to a masonry style. The filler material may be a malleable material that can harden when inserted into the recess. In an embodiment, a filler material may formed and/or comprise one or more preformed objects, e.g. ornamental elements like coloured plates or strips and/or protective elements covering a portion of an adjacent support block. A building block may be formed at least partially to accommodate such object, e.g. having a widened groove, and/or the filler material may be attached to a support block.

BRIEF DESCRIPTION OF THE DRAWINGS

The above-described aspects will hereafter be more explained with further details and benefits with reference to the drawings showing a number of embodiments by way of example.

DETAILED DESCRIPTION OF EMBODIMENTS

Figure 1:
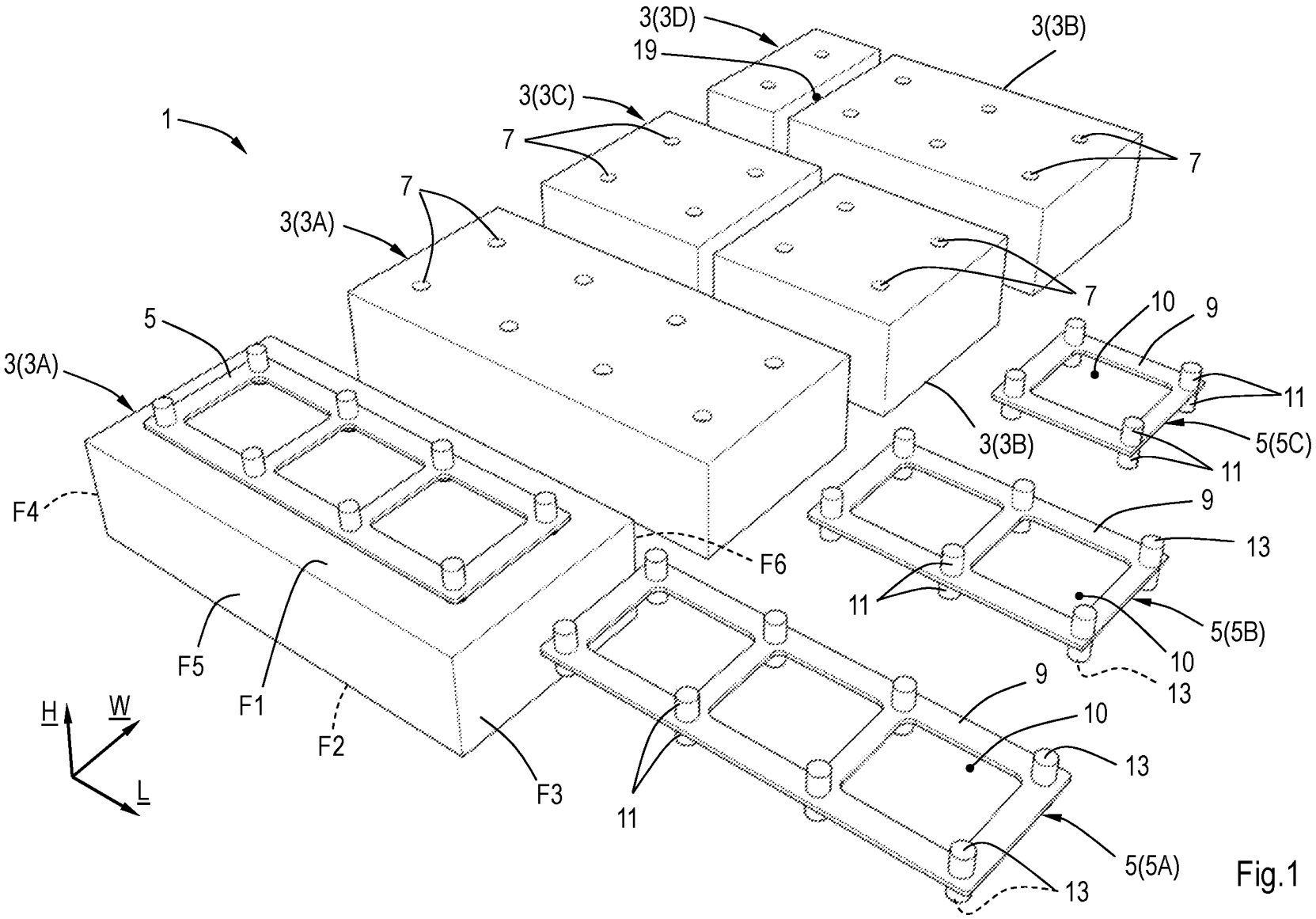
FIG. 1 shows an assembly for constructing at least part of a wall.

It is noted that the drawings are schematic, not necessarily to scale and that details that are not required for understanding the present invention may have been omitted. The terms "upward", "downward", "below", "above", and the like relate to the embodiments as oriented in the drawings, unless otherwise specified. Further, elements that are at least substantially identical or that perform an at least substantially identical function are denoted by the same numeral, where helpful increased by hundreds and/or individualised with alphabetic suffixes.

Further, unless otherwise specified, terms like "detachable" and "removably connected" are intended to mean that respective parts may be disconnected essentially without damage or destruction of either part, e.g. excluding structures in which the parts are integral (e.g. welded or moulded as one piece), but including structures in which parts are attached by or as mated connectors, fasteners, releasable self-fastening features, etc. The verb "to facilitate" is intended to mean "to make easier", rather than just "to enable".

Figure 2:
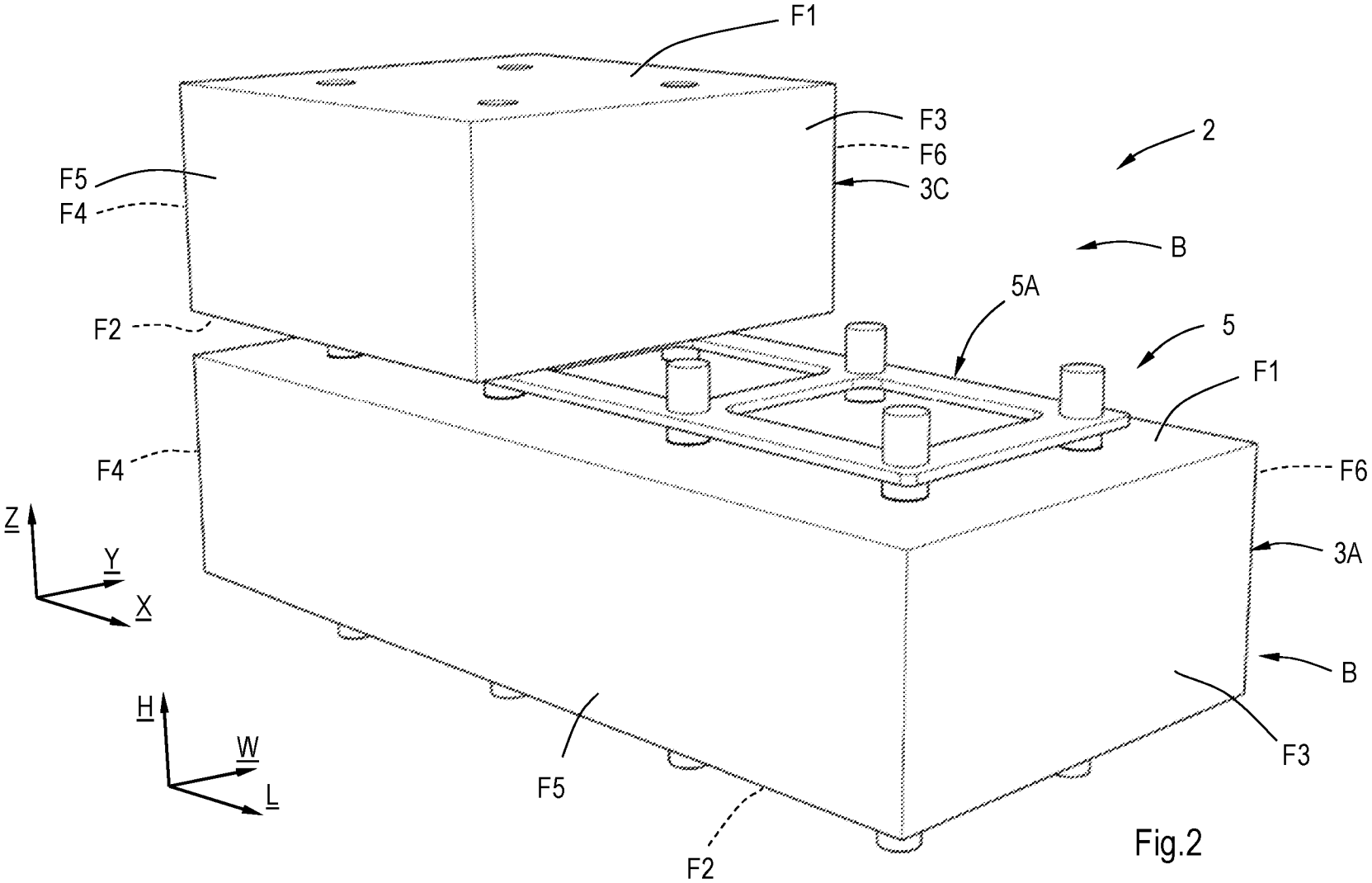
FIG. 2 shows part of a wall using the assembly of FIG. 1.

FIG. 1 shows (parts of) an assembly 1 for constructing at least part of a wall 2, as indicated in FIG. 2, from building blocks 3 and support blocks 5. In an erect wall 2, the building blocks 3 and support blocks 5 are stacked in a vertical direction Z as alternating layers B, S, which themselves extend generally in horizontal directions X and Y. Locally, the wall 2 may have a length direction L and a width direction W in horizontal directions and a vertical height direction H.

Each building block 3 comprises opposite pairs of faces F1 and F2; F3 and F4; and F5 and F6, respectively. Faces of at least one pair of opposite faces F1, F2; F3, F4; F5, F6; comprises a plurality of recesses 7 arranged spaced from each other in the respective face. As shown, the recesses may be blind holes defined by surrounding wall portions. The building blocks 3 may have various sizes as generally indicated with reference symbols 3A-3D in FIG. 1.

Each support block 5 comprises a body 9, and a plurality of protrusions 11 on opposite top and bottom sides of the body 9. Here, the protrusions 11 are formed as substantially coaxial solid cylindrical rod portions of circular cross section, but other relative positions and shapes may be provided. The body 9 preferably is generally plane as shown here and may comprise one or more openings 10, providing the body 9 with a frame-like shape. The support blocks 5 may have various sizes as generally indicated with reference symbols 5A-5C in FIG. 1. Note that the body 9 and some or all of the protrusions may be made of different materials like relatively soft polymeric material for the body 9 and one or more relatively hard materials for the protrusion 11, like glass- and/or metal-reinforced polymers.

Each recess 7 of the plurality of recesses 7 comprises a recess support structure 8 inside the recess, e.g. a flat portion on an end face terminating the blind hole 7 (not visible in FIGS. 1-2). Each protrusion 11 of the plurality of protrusion comprises a protrusion support structure, e.g. a flat end face 13 of the protrusion 11.

The building blocks 3 and/or support bocks 5 may have various sizes as shown and generally indicated with reference symbols 3A-3D and, respectively, 5A-5D in FIG. 1. However, of at least several building blocks and support blocks, the recesses 7 and protrusions 11 are arranged in a matching pattern, here a generally rectangular pattern, in particular square pattern. However, different patterns including triangular, hexagonal or other regular or irregular patterns may be provided. The recesses 7 and protrusions 11 are further formed such that the protrusions 11 are receivable in the recesses 7 to be accommodated and cooperate with each other to form the alternating layers of building blocks and support blocks stacked on top of each other such that the protrusions in one layer are accommodated in the recesses of the adjacent layer, and such that relative movement of the respective blocks in the W and L directions (X and Y directions) is restricted or prevented. The respective support structures 8, 13 engage each other and position and support the respective higher block 3/5, on the respective lower block 5/3 in each layer pair.

Further, the recesses 7 and protrusions 11 may be mated in the sense that the protrusions closely fit into the recesses with very little play in horizontal direction (XY), reducing tolerances in width and/or length directions of the wall.

Figure 3:
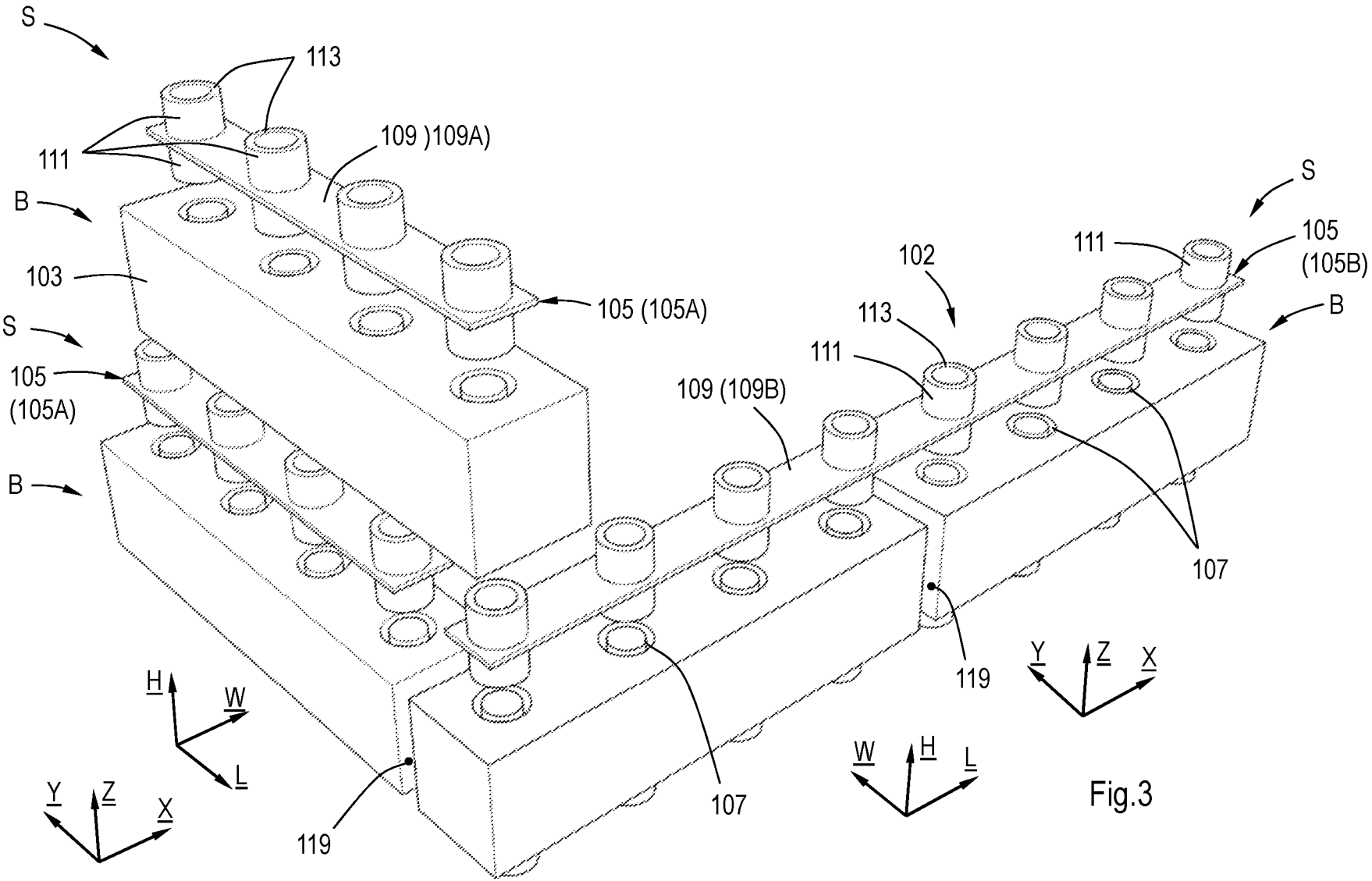
FIG. 3 shows another embodiment of an assembly for constructing at least part of a wall (shown in explosion)
Figure 4:
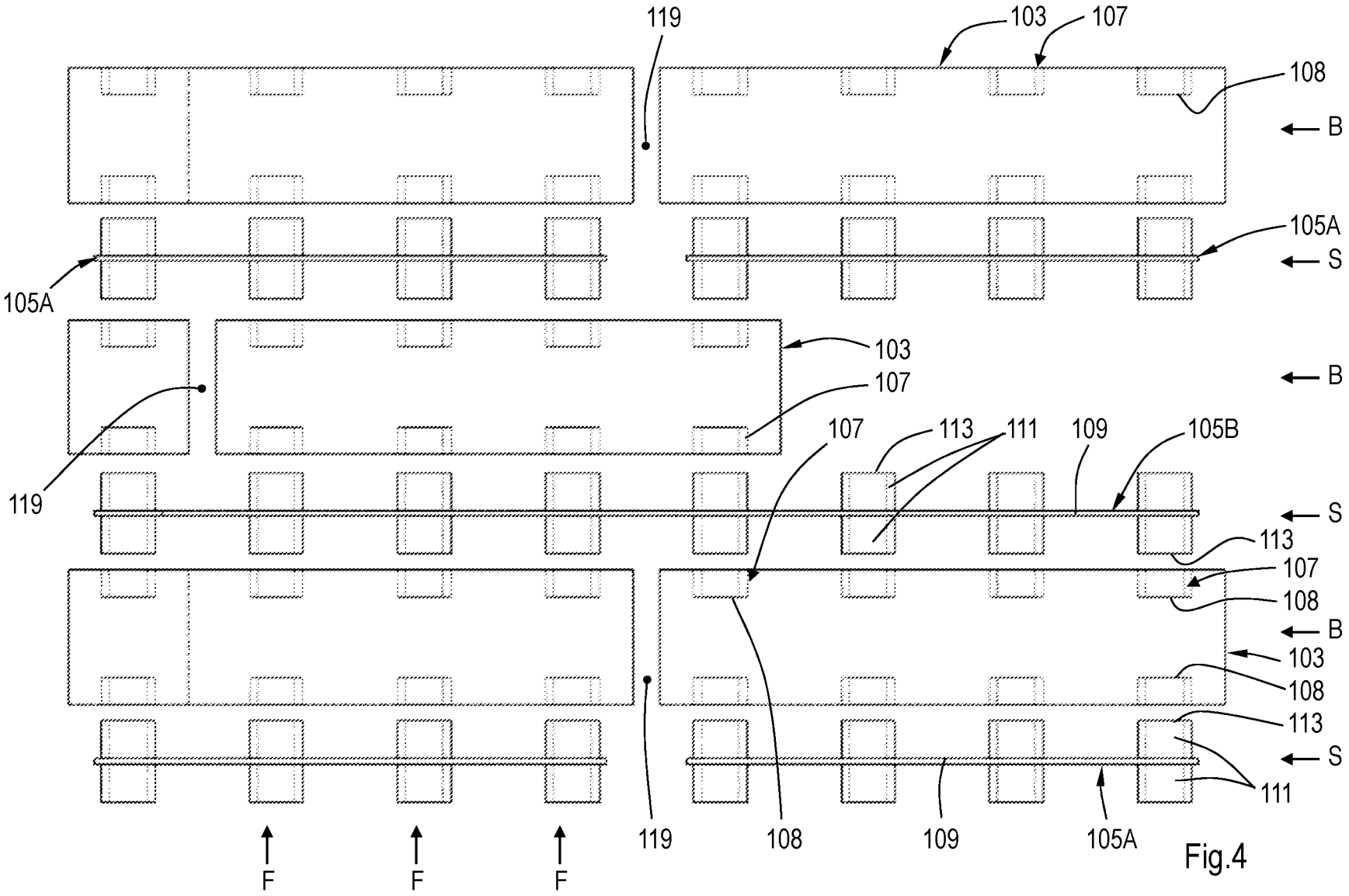
FIG. 4 is a schematic side view of a wall in accordance with FIG. 3.

FIGS. 3 and 4 show another embodiment; an assembly 101 for constructing at least part of a wall 102, as indicated in FIG. 4. Here, the support blocks 105 are provided with protrusions 111 formed as hollow circular cylinders extending from a body 109; the annular top surfaces 113 of the protrusions form the protrusion support structures. Different from FIGS. 1-2 in FIG. 3 the protrusions 111 are arranged in a single line pattern rather than in a distribution pattern in two directions W, L as before (FIGS. 1-2).

Depending on the relative dimensions, the support blocks 105 may be used in combination with the building blocks 3, in particular two support blocks 105 being arranged adjacent each other (not shown), to fit and operably engage the recesses 7 of the building blocks 3 for stacking a wall.

However, as particularly shown in FIG. 3, the building blocks 103 may be provided with annular recesses 107 comprising recess support structures 108, here optionally formed by bottom portions of the annular recess, see FIG. 4.

For post-processed building blocks, annular recesses may reduce the amount of material to be cut or otherwise removed from the building block relative to forming, like in FIGS. 1-2, a completely empty hole of equal extent (e.g. here: outer diameter) in the face. At the same time, an annular structure may be formed, in particular: may be cut, more easily than a straight or angular recess, e.g. by hollow-core drilling. Note that the size of the recess 107 and/or distribution of recesses 2, 102 in the face (F1, F2, etc) in a width direction W of the wall 2 or 102 may affect or even determine a lateral stability of the wall 2, 102. Also, a remaining core 117 in an annular recess may convey an impression of strength and may actually provide strength to the wall as a hole by engaging and laterally supporting the cylindrical wall portion of a cylindrical support protrusion 111.

As indicated in FIG. 3, a support block may at least partly be arranged so that at least some of its protrusions on one side are operably received in, and cooperate with, plural adjacent building blocks. Thus, the building blocks and support blocks interengage and interlock each other, defining relative positions and strength of the wall may be increased. Also, constructing a wall by appropriately assembling the respective building blocks and support blocks is facilitated. For one or more of these reasons, a support block may be formed larger than a building block in at least one direction, e.g. being longer (L-direction).

Any possible spaces 19, 119 between adjacent building blocks in a layer may be filled by additional material, which may take the form of a plate-like body and may have protrusions matching recesses in the associated faces F3, F4. Such body may be connectable with one or more support blocks 5, 105. In the latter case, it may be noted that any interconnection, in particular fixation between adjacent layers of the same type (B-B, S-S) or of different type (B-S, S-B) may further strengthen the wall 2, 102. Also, tolerances in spacing of building blocks 103 may be reduced. Attachment or fixation may be performed by any suitable means, like screws, bolts and nuts or threaded holes, etc. and even pieces or loops of string and/or belts, for which support blocks 5, 105 may be provided with locks like (series of) V-shaped recesses and/or serrations and/or other clamping mechanisms. Also or alternatively ratchet-and-pawl-based binding strips (a.k.a. "tie-wraps") may be used. The latter may be looped and/or may be integrated at least partly into the support blocks.

Figure 5:
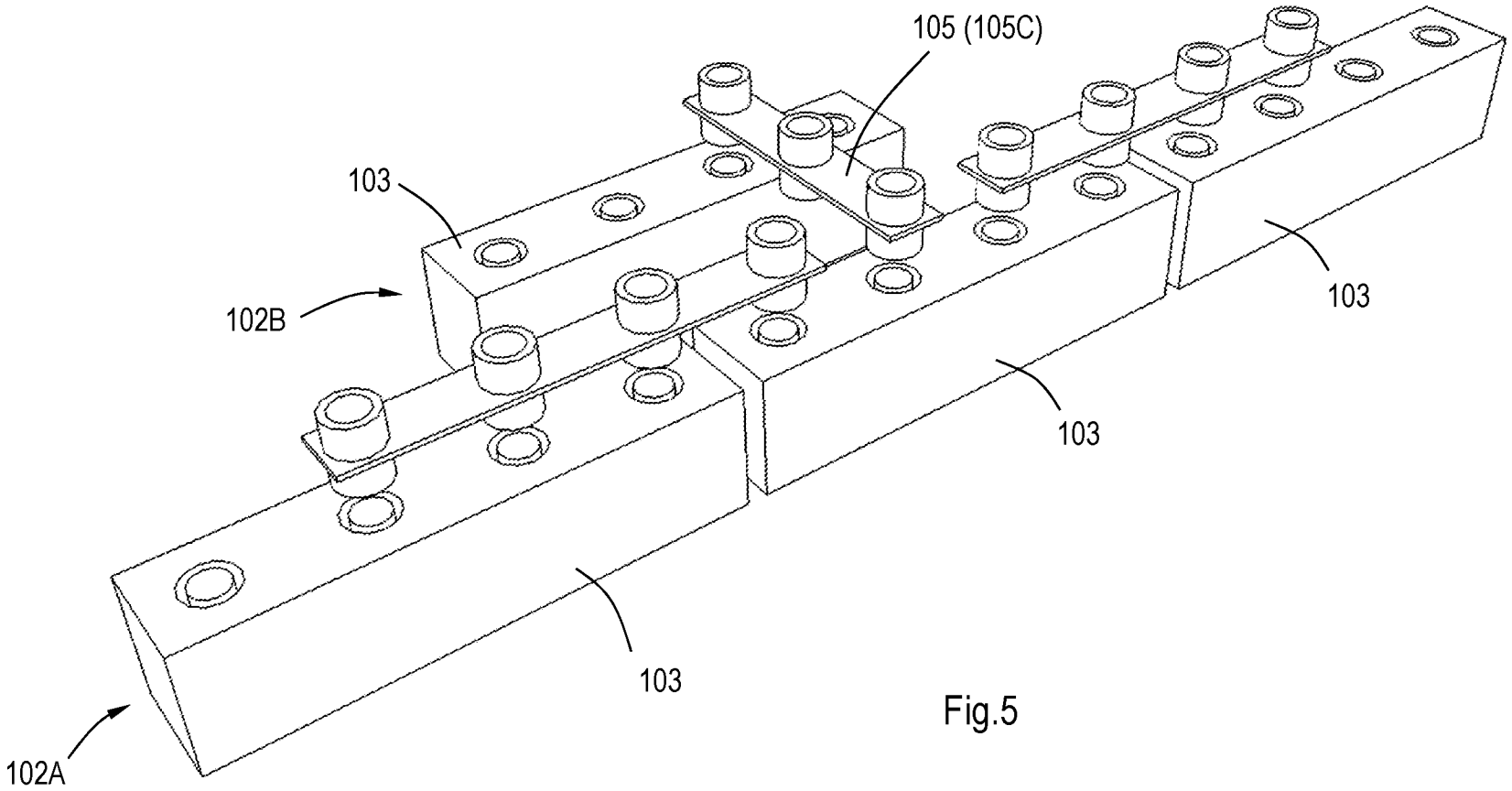
FIG. 5 shows use of a support block as a wall anchor between adjacent walls.
Figure 6:
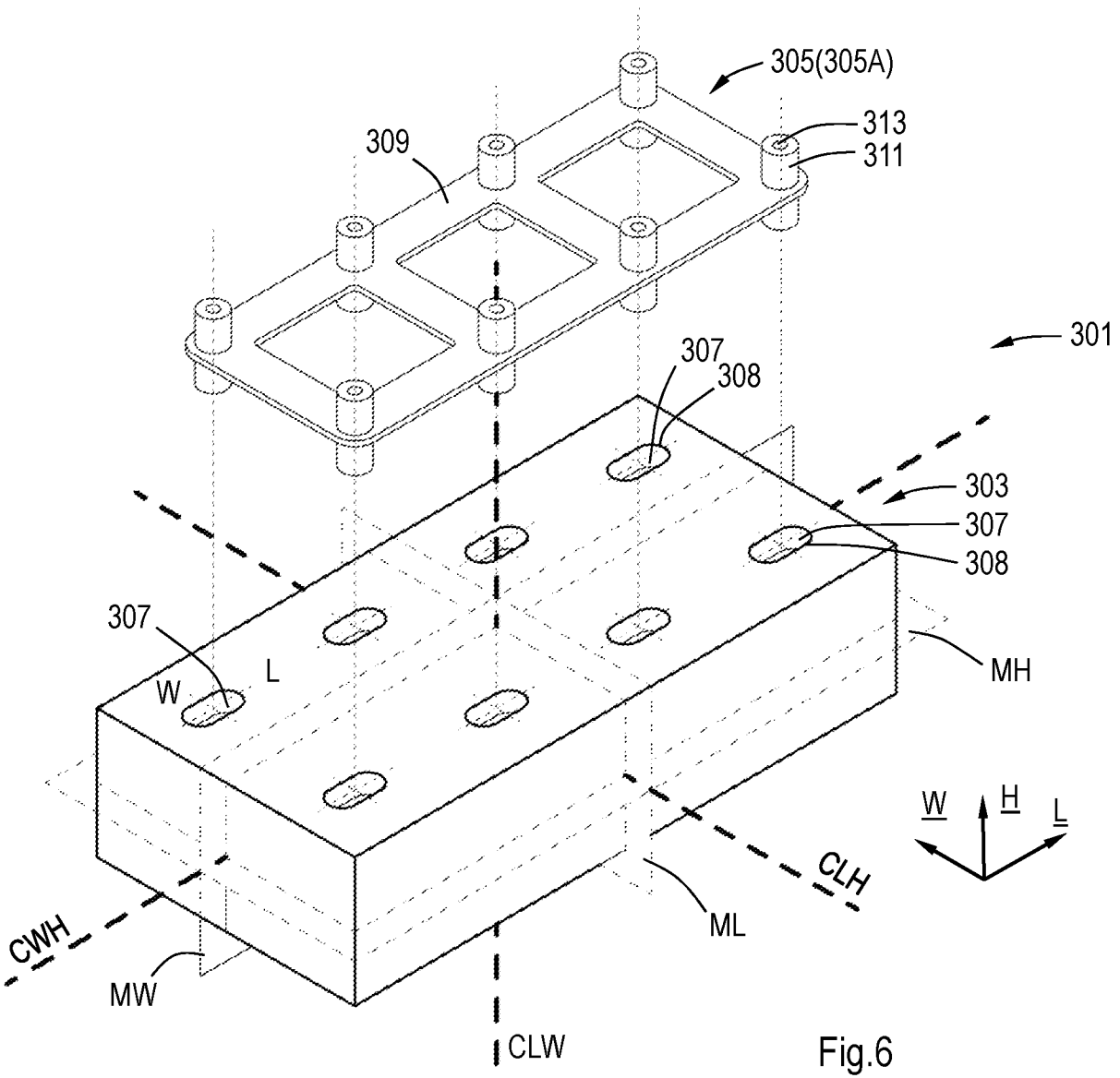
FIG. 6 shows a further embodiment of an assembly for constructing at least part of a wall.

Protrusions and recesses having a rotational symmetry, like rectangles (2×2-fold symmetry), squares (4-fold symmetry), circles (infinite-fold symmetry) and the like, together with an appropriate pattern of protrusions and recesses may facilitate arranging a support block in a different directions relative to a building block. Thus, a support block 105 (105C) may e.g. be arranged sideways perpendicular (in W-direction) to a length direction (L) of a building block 103 from one wall 102A to extend to an adjacent wall 102B and function as a wall anchor connecting both walls 102A, 120B, see FIG. 5. This may obviate providing additional anchors and/or us of other materials.

Figure 7:
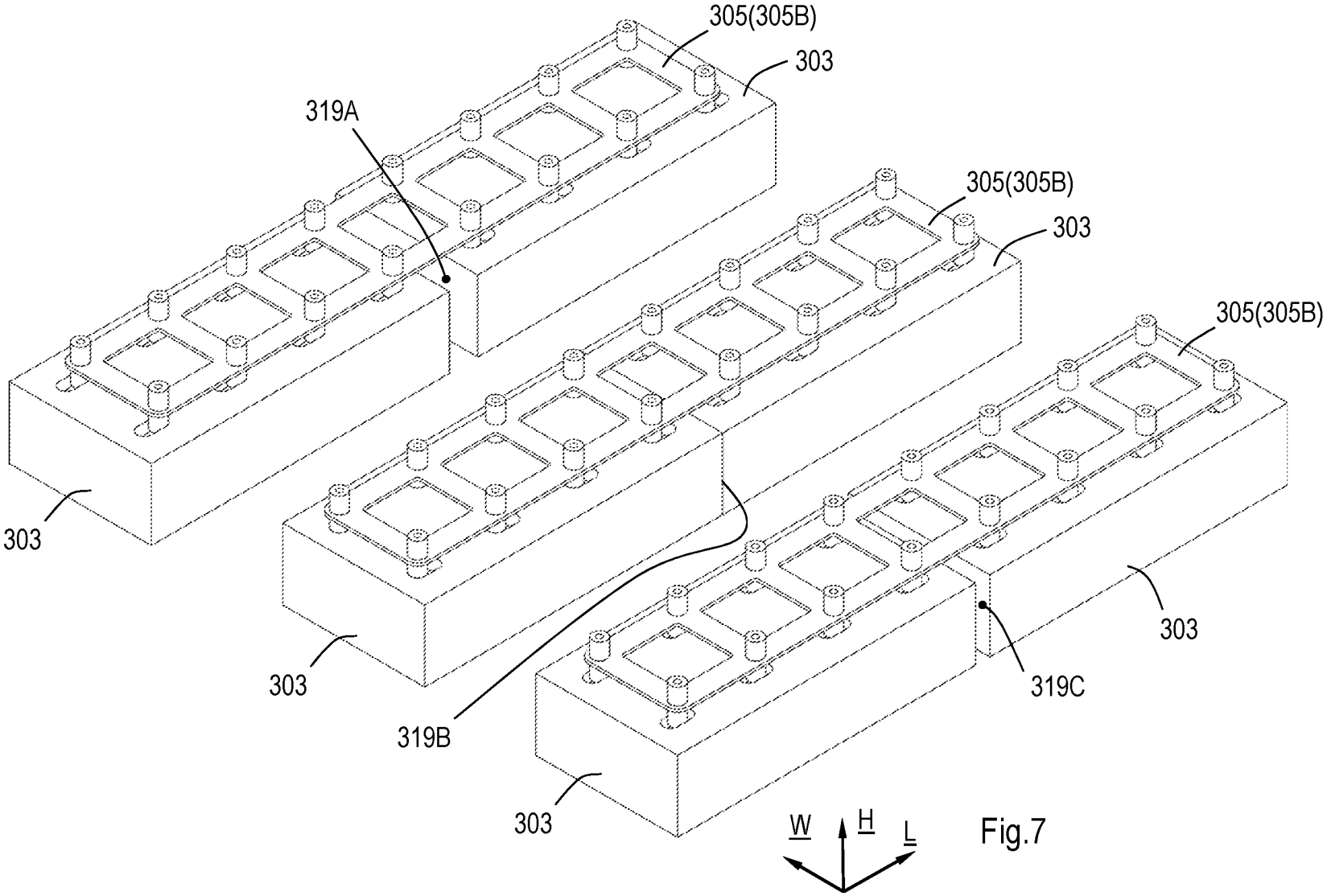
FIGS. 7-8 shows different arrangements of building blocks and support blocks of the assembly embodiment of FIG. 6.
Figure 8:
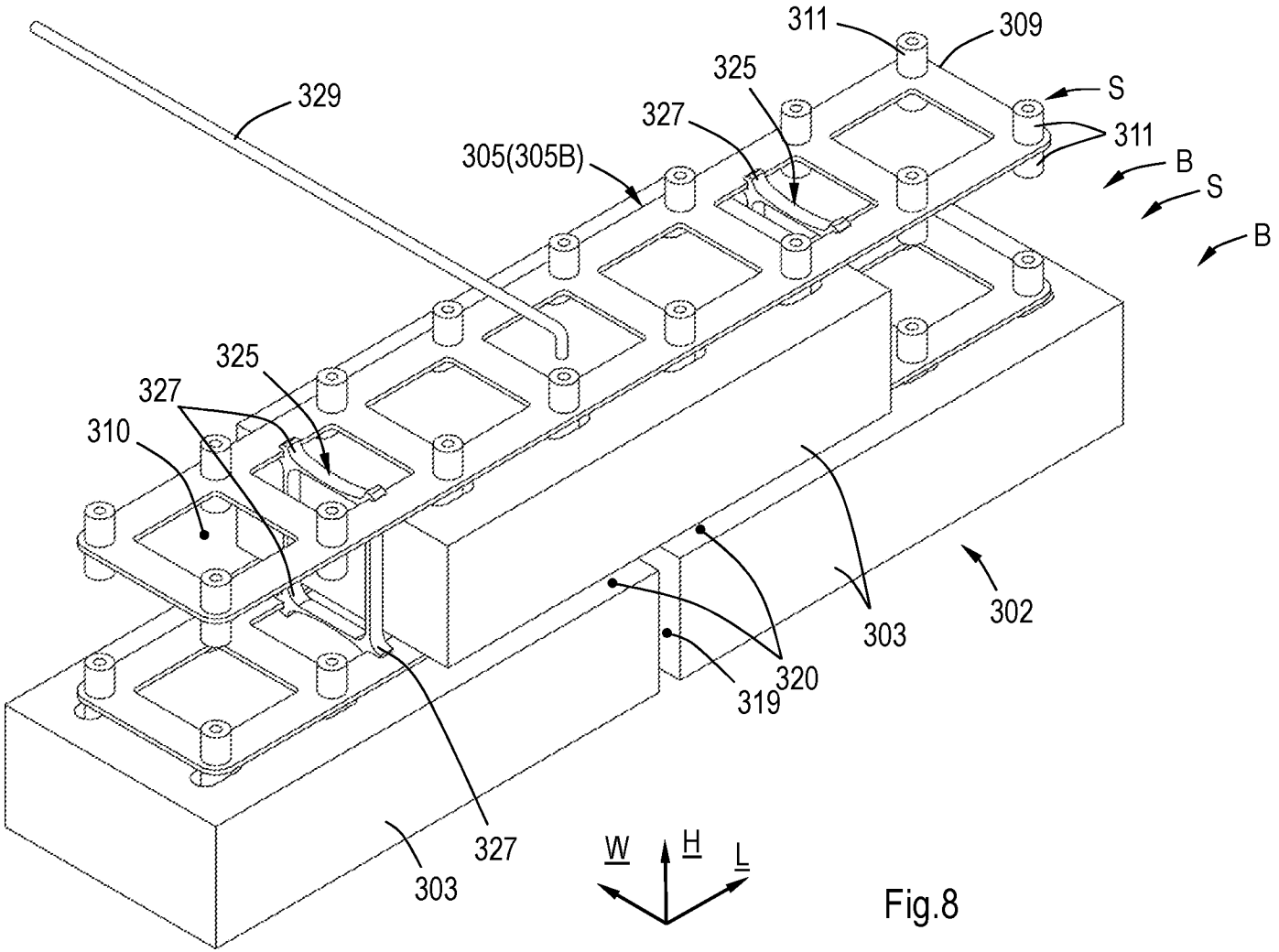
Figure 9:
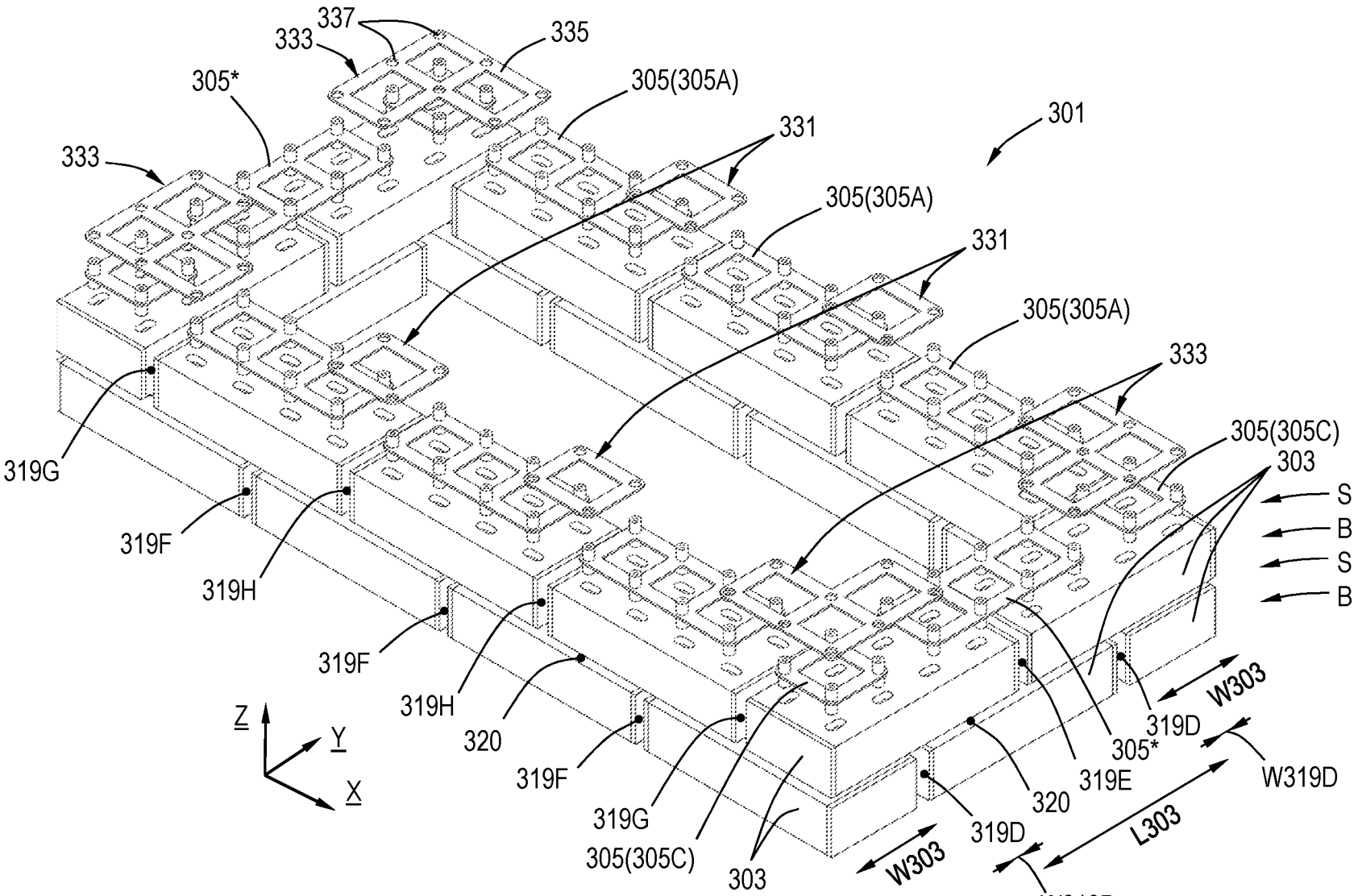
FIG. 9 shows a wall construction in accordance with FIGS. 6-8.

FIGS. 6-9 show a further embodiment; an assembly 301 comprising building blocks 303 and support blocks 305 (305A-305C) for constructing at least part of a wall 302, as indicated in FIGS. 8-9. In this embodiment, the building blocks 303 are provided with recesses 307 having an elongated shape.

In the shown variant, the elongated recesses 307 have a relatively large size in a longitudinal direction 1 parallel to the length direction L of the building block 303, and a relatively small size in a transverse direction w parallel to the width direction W of the building block 303.

Here, the recesses 307 are cut into the building block 303 relative to references per direction L, W, H, determined as midplanes ML, MW, MH of the building block, e.g. determined with respect to an average of, respectively, the length, the width and the thickness of the building block. The midplanes ML, MW, MH cross in a center lines CLW, CLH, CWH which in turn cross in a center point C (not indicated) which may form a primary reference of the block 303. Note that a reference point, line and/or plane may also be determined differently, e.g. relative to a particular feature of a building block, e.g. a marked, coated, sculpted or otherwise particularly treated side.

As before, each recess 307 of the plurality of recesses 307 comprises a recess support structure 308 inside the recess 307, e.g. a flat portion of a bottom 308 of the recess 307. Each protrusion 311 of the plurality of protrusions 311 comprises a protrusion support structure, e.g. a flat end face 313 of the protrusion 311. Note that the protrusions 311 may be hollow as shown, e.g. to save material. The support blocks 305 may be similar or identical to the embodiment of FIGS. 1-2. The support blocks 305 may have various sizes as shown generally indicated with reference symbols 305A-305C in FIG. 6-9. Also or in addition, support blocks (not shown) may be provided wherein the protrusions have a non-circular cross sectional shape, e.g. square, oblong rounded and/or otherwise elongated, the shape corresponding to the longitudinal direction of the elongated recesses. This may further fortify a wall built from the assembly. Also or in addition, one or more of the protrusions may have profiled shape, e.g. ribbed shape, in cross section. E.g. protrusions could be formed as substantially X-shaped, Y-shaped, T-shaped, or star-shaped rods protruding from the body of the support block, as seen in top view.

Note that a wall (not shown), may comprise a combination of building blocks according to plural embodiments, e.g. in particular according to FIGS. 1-2 and FIGS. 6-9.

Best seen in FIG. 7, the elongated recesses 307 of building blocks 303 may cooperate with the protrusions 311 of supporting blocks 305 connecting two adjacent building blocks 303. This may enable that, when assembled, the building blocks 302 may be arranged at different separations, providing a space 319 between facing faces (here: end faces F3, F4) of the building blocks 303 between a wide space 319 (top image); a small space 319B or even no space if and when the building blocks 302 can contact each other (center image); or an intermediate width space 319C (bottom image). The maximum and minimum spaces may be determined by the relative sizes and positions of the recesses 307 and protrusions 311.

FIGS. 8 and 9 show that a support block 305 may at least partly be arranged so that at least some of its protrusions 311 on one side are operably received in, and cooperate with, plural adjacent building blocks 303. E.g. see in FIG. 8: a support block 305B formed larger than a building block 303 in at least one direction e.g. being longer (L-direction), and/or see in FIG. 9: support block 305*.

FIG. 8 further indicates that in a space 319 between two adjacent building blocks 319 a body 325 may be arranged, filling the space 319 at least partially in width and height directions (W, H). Here, the bodies 325 are provided as open frame-like elements with optional hooks 327 for attachment to the bodies 309 of support blocks 305 and fixation of adjacent support block layers S-S. Note that, one or more of the bodies 325 may have a different shape and/or size (e.g. in the W and/or L direction), and/or may have a different construction such as being solid. One or more building blocks may be provided with grooves in side faces for accommodating at least part of such bodies 325 (not shown). This may, e.g., facilitate longitudinal adjustment of adjacent building blocks.

Also or in addition to the anchoring technique using a support block (cf. FIG. 5; not separately shown), FIG. 8 further shows use of a more traditionally shaped anchor 329 for attachment of the wall 302 to an adjacent wall (not shown), e.g. comprising a hook to engage (the body 309 of) a support portion 305; such anchor 329 may fit in a space 319 between adjacent building blocks 303.

FIG. 9 shows an exemplary generally rectangular wall construction with two long wall portions in X-direction and two short wall portions in Y-direction. The different building block layers B, B of the short wall portions will have the same size in Y-direction if the widths of the interstitial spaces 319D, 319E are sized correctly, and will only look pleasing if the widths are approximately equal; such equality may also improve strength of the wall portion. This also applies mutatis mutandis for (the spaces 319F, 319G, 319H of) the long wall portions in X-direction. The assembly 301 of building blocks 303 and support blocks 305 enables adjusting the relative positions of building blocks and therewith accommodate tolerances in them. Vertical spaces 320 are determined by interaction of the support structures (307, 308; 311, 313) of the building blocks 303 and support blocks 305.

FIG. 9 further shows different embodiments of optional links 331 (331A, 331B) which may be comprised in the assembly 301. As may be seen from FIG. 9, in order to determine the sizes of the walls 302 in the construction accurately, within a support block layer S adjacent support blocks 305 are connected together with support links 331 in length direction and support links 333 defining corner portions. The support links 331, 333 may have bodies 335 of the same or similar material and/or construction as the support blocks 305. For connection, the shown support links 331, 333 comprise holes 337 fitting a protrusion 311 of an adjacent support block 305. The sizes of support links 331, 333 in respective width directions match the sizes of (the protrusions of) the support blocks for proper interconnection. The sizes of support links 331 in respective length directions determine a separation of (protrusions 311 of) linked support blocks 305 and thus determine a length of a wall portion; the building blocks 303 coupled with the respective assembly of support blocks 305 and links 331, 331 may be arranged to provide a desired spacing, e.g. all spaces 319 being substantially equally wide. Note that in a joint of plural wall portions, such as in a corner, the separation and spacing (spaces 319) between building blocks may differ, which may be accommodated by appropriate selection of support link sizes when using substantially identical support blocks for each of the respective wall portions. Also, support links may accommodate a transition between one type of support block and another type.

Differently sized support blocks and/or support links, in particular with respect to the separation of protrusions may be colour coded for easy recognition. It is noted that the spaces 319, 320 may be at least partly filled with a mortar, a clay, a polymer, and/or another filler material, thus covering and obscuring support blocks 5, 105, 305, vertical bodies 325 and/or links 331, 333.

The assembly may further comprise support blocks (not shown) having protrusions on only one side of the support block body, e.g. for forming a substantially flat base layer or top layer of support portions. E.g. a wall portion may be accurately sized by arranging a series of interconnected support portions (possibly using support links) on a base surface with the protrusions upward according to a predetermined size and/or pattern as support block layer S and a template for stacking thereon a first layer B of building blocks; positions of the building blocks being determined by the initial layer of support blocks. Also or alternatively, such one-sided support blocks may be used at openings in the wall e.g. for windows, with the protrusions pointing only downward for a bottom sill and only pointing upward when supported on a top sill. Note that relative positions of different layers may be arranged and/or checked by comparing relative positions of (e.g. alignment of) protrusions of support blocks rather than by comparing relative positions of building blocks; this obviates having to account for tolerances in and/or erratic shapes of building blocks.

End space (19, 119, 319D, 319G) filler bodies may be provided with hooks engaging the bodies 9, 109 of support members 5, 105 of adjacent layers S, e.g. at or in openings of support members (e.g. openings 10, 110).

Figure 10:
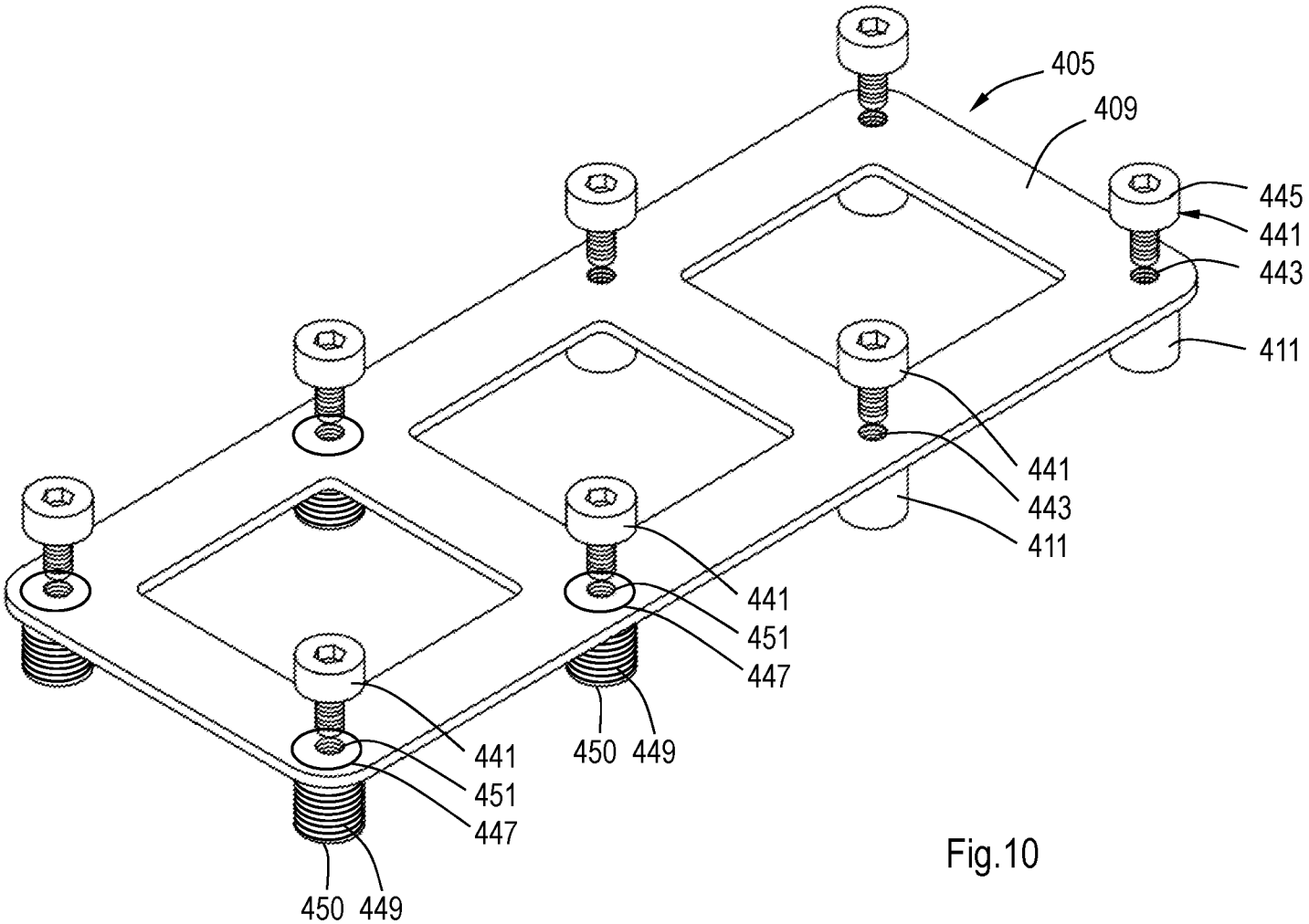
FIG. 10 shows an embodiment of a support block.

The assembly may further comprise adjustment support blocks wherein one or more of the protrusions, preferably all protrusions, are size-adjustable, e.g. comprising complementary threaded portions. As an example, FIG. 10 shows a support block 405 wherein protrusions 411 on one side of the body 409 are provided as threaded objects, here bolts 441, fit into threaded holes 443. In this case, optionally, if bolts 441 or other protrusions are absent, the support block 405 has no protrusions on that side so that the support block 405 may form a substantially flat base layer or top layer as described above.

The bolt 441 provides the support structure of the thus-formed protrusion 411, in particular the top surface of the head 445. Note that instead of an internal hexagonal structure as shown, an external control portion, e.g. a head 445 of the bolt 441 may be provided, e.g. one or more flat surfaces such as a hexagonal head enabling adjustment from aside relative to another object, e.g. a levelling rule.

Optionally, as also indicated in FIG. 10, an adjustment support block may comprise a body having one or more threaded portions 447 through which a complementary threaded element 449 is fit to provide a protrusion providing a support structure 450 on one side of the body, wherein the element 449 itself is provided with an additional threaded portion for connecting an accordingly complementary threaded further element as a protrusion providing a support structure to the opposite side of the body; in FIG. 10 the additional threaded portion is formed as an internal threaded portion 451 and the further element as a matching bolt 441. By individual adjustment of the respective elements 441, 449 relative to the body 409 of the support block 405, (the support structures of) the support block 405 may be finely adjusted.

Also or alternatively, adjustable protrusions may be provided with external threads onto which e.g. threaded nuts and/or threaded caps could be fit. Other adjustment portions could also be provided as protrusions.

Size-adjustable protrusions allow establishing and/or correcting deviations from a default size, e.g. ascertaining a horizontal orientation of a building block layer B stacked on the adjustment support block and/or accommodating differently sized building blocks. In particular, (protrusions of) an at least partly single-sided support block for forming a substantially flat base layer may be adjustable to accommodate for a non-horizontal and/or uneven base surface.

Figure 11:
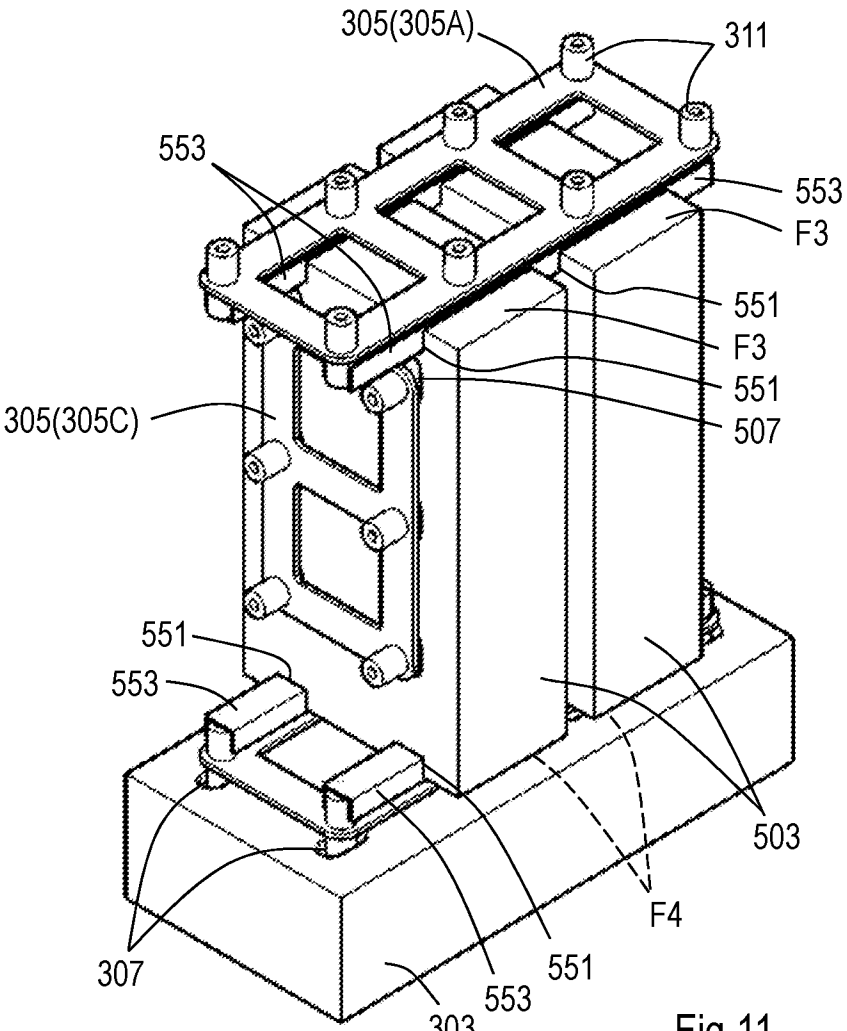
FIG. 11 shows another assembly of building blocks and support blocks in a different arrangement.

FIG. 11 shows an embodiment wherein building blocks 503 are arranged standing, i.e. on a relatively short side, compared to other embodiments shown. Such standing orientation is particularly suited for ornamental portions of masonry and/or portions having a particular structural significance e.g. as typically found below and/or above windows, doors, etc. However, also larger wall portions, e.g. panels of multiple rows of building blocks or entire walls, may thus be realised. As shown in FIG. 11, adjacent standing building blocks may be connected and/or aligned using any suitable support blocks as disclosed herein. Note that adjustment support blocks (e.g. 405 in FIG. 10) may be used to provide and/or control angles between adjacent building blocks e.g. for a fanning arrangement of non-parallel standing building blocks, such as used for defining an arch and/or matching a curved door frame and/or window frame (not shown).

The building blocks 503 in FIG. 11 are provided with optional additional recesses 551 formed in side faces F3, F4 in addition to the recesses 7, 107, 307 discussed above. Such additional recesses may be formed to match protrusions in adjacent support blocks, e.g. similar to and according to described details, options etc. of any one of the recesses discussed in this disclosure. As an option, in FIG. 11, the additional recesses 551 are formed as grooves, preferably formed into the building block 503 by cutting and/or with respect to one reference, e.g. a midplane ML (cf. FIG. 6). Thus, a position of the building block 503 may be free in the longitudinal direction of the groove relative to the positions of protrusions on the support blocks 505 if the latter are not without protrusions on the side of their body facing the standing building blocks 503. Spaces between protrusions of the support blocks may be at least partly filled up, e.g. forming ribs, and/or one or more caps 553 bridging spaces between adjacent protrusions may be provided, such fillings and/or caps 553 and the recesses (grooves 551) having matching sizes so that the latter can accommodate the former. This may increase freedom of positioning of the standing building blocks and/or increase support reliability for the standing blocks. Note that the fillings and/or caps 553 and grooves 551 preferably provide matching support structures engaging each other and position and support the respective higher block (e.g. 503, 303) on the respective lower block (e.g. 303, 503) and relative movement of the respective blocks (e.g. 303, 503) in two mutually perpendicular directions generally parallel to the layers being restricted. In particular in case of such freedom of positioning of the standing building blocks, support blocks may assist in determining a desired spacing of the standing building blocks and ensuring meeting tolerances, as discussed herein.

Figure 12:
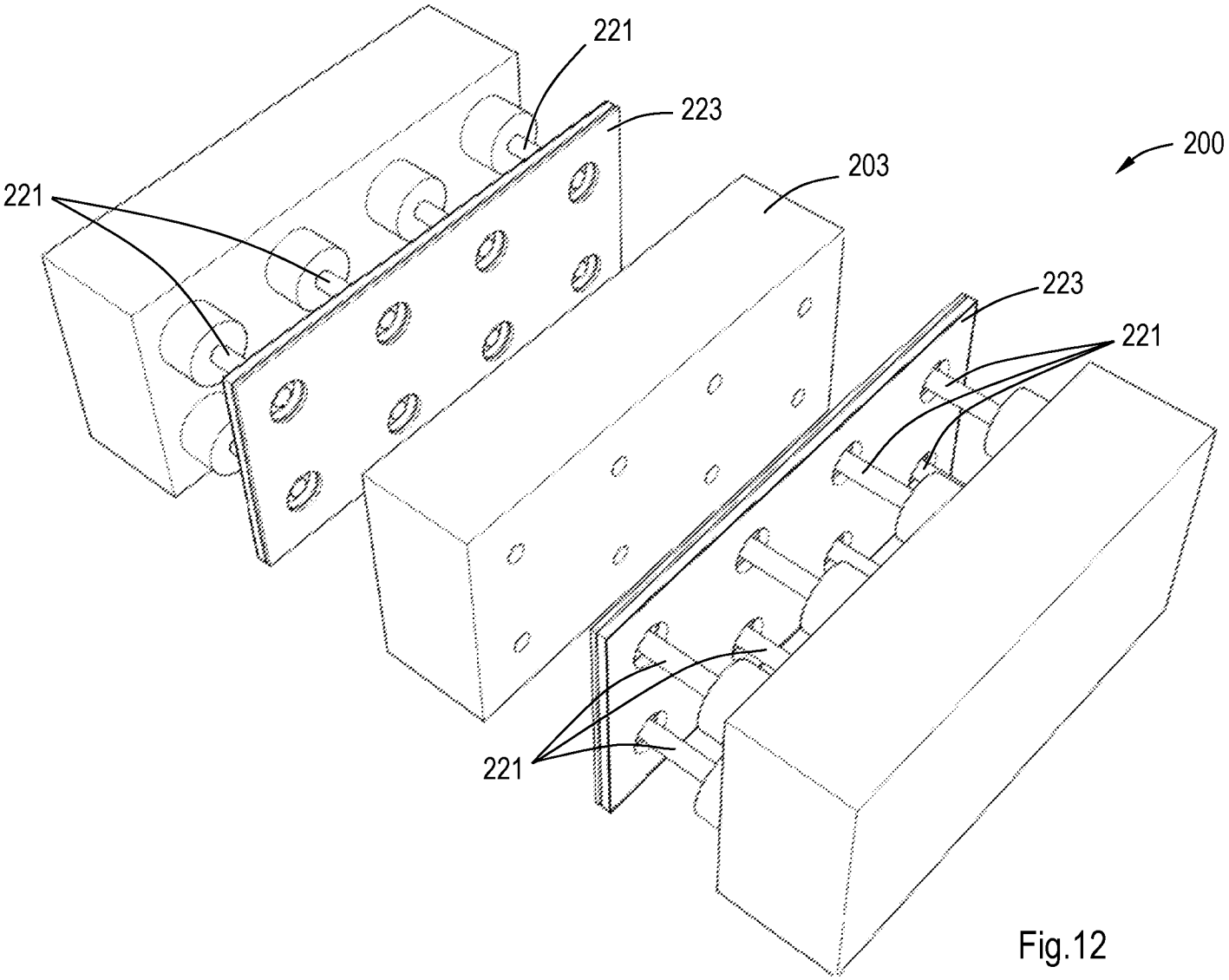
FIG. 12 indicates manufacturing a building block.

FIG. 12 shows a method of manufacturing a building block, by example showing a building block according to FIGS. 1-2. Here, the shown method is a method of post-processing. In a building block, a plurality of recesses is cut, here by drilling or milling all recesses together by a drilling apparatus 200 comprising plural opposite sets of drills 221. In the apparatus 200 the building block is positioned and fixed. Here, e.g. the building block may be clamped by clamping plates 223. The drill bits may be shaped to provide the recesses formed by them with a particular shape, e.g. having a varying diameter or being hollow for making annular recesses. Preferably, all drills 221 are of the same type and/or shape, at least pairwise for opposite drills 221.

The building block and/or the sets of drills 221 may be controllably moved with respect to each other for milling elongated recesses into the building block (cf. FIGS. 6-9) rather than drilling cylindrical holes (cf. FIGS. 1-2) and/or annular recesses (cf. FIGS. 3-5) although annular recesses and/or other shapes could also be made by controlled relative movement of the building block and/or the sets of drills 221.

At least some of the drills 221 may individually or collectively be checked and/or controlled regularly for position and/or wear so as to ensure proper forming of the recesses. The drills 221 are configured to drill recesses in the desired respective face $F_x$ (x=1, 2, 3, . . . ) of the building block 3, 103, 203 to a depth corresponding to the desired and predetermined position of the respective recess support structure. Such position is determined for each drill and recess of/for opposite faces relative to a single common reference, irrespective of external properties of the building block regarding size, shape and/or surface structure. In particular, recesses in opposite sides are defined relative to one common reference instead of from both opposite sides independently. This prevents that (lack of) tolerances in the shape, size and/or structure of the building blocks extend into (lack of) the tolerances of the wall as a whole.

Thus, stacking tolerances may be tightly controlled although the building blocks may have comparably rough and/or erratic shapes, structures, textures etc.

The drills 221 may be similarly used for cutting grooves 551 in building blocks 503 shown in FIG. 11. Also or alternatively, the apparatus 200 may comprise additional cutters for cutting grooves 551, and/or other cutters may be provided for such purpose.

The disclosure is not restricted to the above described embodiments which can be varied in a number of ways within the scope of the claims. For instance elements and aspects discussed for or in relation with a particular embodiment may be suitably combined with elements and aspects of other embodiments, unless explicitly stated otherwise.

Although support planes may be preferred, e.g. for ease of manufacturing, of control and/or of checking, in some embodiments the support surfaces may be formed at least partly inclined to a vertical direction and/or relative to a main direction of a construction layer (S, B), e.g. in order to assist determining relative positions of the respective blocks. E.g., a support portion may comprise a pointed tip, e.g. a rib or a cone-shape which may be a truncated cone, and the recess may comprise a V-shaped structure like a conical bottom recess or a V-groove-shaped bottom. The latter may be in particular interesting for the embodiments largely according to FIGS. 6-9.

The invention claimed is:

1. An assembly for constructing a wall comprising building blocks and support blocks, wherein each of the building blocks comprises opposite first and second faces, both of the first and second faces comprising a plurality of recesses arranged spaced from each other;

wherein each support block comprises a body and a plurality of protrusions extending from opposite first and second sides of the body;

wherein each recess of the plurality of recesses comprises a recess support structure inside the recess and each protrusion of the plurality of protrusions comprises a protrusion support structure, wherein the recesses and protrusions are arranged in a matching pattern, wherein alternating layers of building blocks and support blocks are stackable on top of each other in a vertical direction such that each recess extends within each block in the vertical direction and vertically stacked building blocks have faces facing each other, and the protrusions in one layer are accommodated in the recesses of an adjacent layer, wherein each protrusion support structure contacts the associated recess support structure within each associated recess to provide support in the vertical direction so as to maintain a vertical position of a respective higher block on a respective lower block, relative movement of the respective blocks in two mutually perpendicular directions generally parallel to the layers is restricted, and wherein when stacked, the building blocks are separate from each other and in each vertical pair the building blocks do not support each other apart from at the support structures.

2. The assembly according to claim 1, wherein each of the support blocks has a length, a width, and a height, in, respectively, a length direction, a width direction, and a height direction, and the protrusions are spaced at least in the length direction of the support block, wherein in the building blocks, the recesses are accordingly distributed in the first and second faces.

3. The assembly according to claim 1, wherein, the building blocks and the support blocks are configured such that one or more of the building block or one or more of the support block when assembled in a layer at least partly overlaps plural blocks in an adjacent layer.

4. The assembly according to claim 1, wherein the plurality of recesses of each building block is arranged spaced from each other in at least one of a width and height directions, and the assembly comprises matching support blocks.

5. The assembly according to claim 1, wherein in each building block, the recess support structures of the plurality of recesses are formed with respect to one reference.

6. The assembly according to claim 1, wherein at least some of the recesses are formed in the building block by cutting.

7. The assembly according to claim 1, wherein each recess support structure is a support surface and defines a recess support plane, and/or each protrusion support structure is a support surface and defines a protrusion support plane.

8. The assembly according to claim 7, wherein the recess support structures of the plurality of recesses of a building block in at least one of the first and second faces define a common first plane and/or second plane, respectively, and/or wherein the protrusion support structures of the plurality of protrusions of a support block protruding in one direction from the body of the support block define a common first support plane.

9. The assembly according to claim 1, wherein a recess support structure of a recess is formed by a bottom of the recess.

10. The assembly according to claim 1, wherein the recesses in at least one of the first face and the second face extend parallel to each other; and/or the recesses in at least one of the first face and the second face extend perpendicular to the first and/or second face, respectively, and/or each recess extends along an axis, the axis extending perpendicular to the first and/or second face.

11. The assembly according to claim 1, wherein the protrusions on at least one of the first and second sides extend parallel to each other; and or the protrusions in at least one of the first side and the second side extend perpendicular to the first and/or second side, respectively; and/or each protrusion extends along an axis, the axis extending perpendicular to the first and/or second side.

12. The assembly according to claim 1, wherein at least some recesses in at least one of the first face and at least some recesses in the second face extend coaxial to each other, and/or at least some protrusions on the first side and at least some protrusions on the second side of a support block extend coaxial to each other.

13. The assembly according to claim 1, wherein at least some of the recesses have a shape, in a cross section generally parallel to the first face and/or second face, that is at least one of circular, annular and cylindrical, and/or at least some of the recesses have a tapering or conical shape, in a direction generally perpendicular to the first face and/or second face; and/or at least some of the protrusions have a shape, in a cross section generally parallel to the first side and/or second side of a support block that is at least one of circular, annular and cylindrical, and/or at least some of the protrusions have a tapering or conical shape, in a direction generally perpendicular to the first side and/or second side.

14. The assembly according to claim 1, wherein at least some of the recesses in the faces of the vertically stacked building blocks have an elongated slot shape in the respective face, having a relatively large size in a longitudinal direction and a relatively small size in a transverse direction perpendicular to the longitudinal direction, wherein at least some of the protrusions have a shape, in a cross section generally parallel to the first side and/or second side of a support block that is at least one of circular, annular and cylindrical.

15. The assembly according to claim 1, wherein the body of one or more of the support blocks is provided with one or more openings.

16. The assembly according to claim 1, wherein the body and at least some of the protrusions of one or more of the support blocks are formed unitary.

17. The assembly according to claim 1, wherein adjacent support blocks are connected together within a support block layer.

18. The assembly according to claim 17, wherein one or more of the support blocks comprises one or more holes for accommodating a protrusion of an adjacent support block within the support block layer.

19. The assembly according to claim 17, comprising one or more support links for interconnecting adjacent support blocks within the support block layer.

20. The assembly according to claim 1, wherein the protrusions each have heights that are greater than a total height of the corresponding recesses such that supporting force in the vertical direction is transmittable between one of the lower building blocks and one of the higher building blocks through the protrusions and the recess support structures of one or more of the associated recesses, and wherein the supporting force is transmittable between the lower building blocks and the higher building blocks exclusively through the support blocks.

21. A method of building a wall using an assembly comprising building blocks and support blocks, wherein each of the building blocks comprises opposite first and second faces, both of the first and second faces comprising a plurality of recesses arranged spaced from each other, wherein each support block comprises a body and a plurality of protrusions extending from opposite top and bottom side of the body, wherein each recess of the plurality of recesses comprises a recess support structure inside the recess and each protrusion of the plurality of protrusions comprises a protrusion support structure, and wherein the recesses and protrusions are arranged in a matching pattern, the method comprising stacking alternating layers of building blocks and support blocks on top of each other in a vertical direction such that each recess extends within each block in the vertical direction, and the protrusions in one layer are accommodated in the recesses of an adjacent layer, wherein each protrusion support structure contacts the associated recess support structure within each associated recess to provide support in the vertical direction so as to maintain a vertical position of a respective higher block on a respective lower block, and wherein relative movement of the respective blocks in two mutually perpendicular directions generally parallel to the layers is restricted; and transmitting a supporting force in the vertical direction between one of the lower building blocks and one of the higher building blocks at one or more of the associated recesses, wherein the supporting force is transmitted entirely through the support blocks and the stacked building block are vertically se rated from each other by a gap.

22. The method according to claim 21, comprising building the wall using the assembly adjacent another wall using the assembly and connecting the respective walls together with an anchor.

23. The method according to claim 22, comprising forming the anchor of a support block.

24. A building comprising a wall, the wall comprising building blocks and support blocks, wherein each of the building blocks comprises opposite first and second faces, both of the first and second faces comprising a plurality of recesses arranged spaced from each other;

wherein each support block comprises a body and a plurality of protrusions extending from opposite top and bottom sides of the body;

wherein each recess of the plurality of recesses comprises a recess support structure inside the recess and each protrusion of the plurality of protrusions comprises a protrusion support structure, wherein the recesses and protrusions are arranged in a matching pattern, wherein alternating layers of building blocks and support blocks are stacked on top of each other in a vertical direction such that each recess extends within each block in the vertical direction, and the protrusions in one layer are accommodated in the recesses of an adjacent layer, wherein each protrusion support structure contacts the associated recess support structure within each associated recess to provide support in the vertical direction, and wherein the protrusions each have heights that are greater than a total height of the corresponding recesses, so as to maintain a vertical position of a respective higher block on a respective lower block with a gap therebetween, and relative movement of the respective blocks in two mutually perpendicular directions generally parallel to the layers is restricted.

* * * * *